US006259192B1

(12) United States Patent
Becker et al.

(10) Patent No.: US 6,259,192 B1
(45) Date of Patent: Jul. 10, 2001

(54) ELECTRIC LAMP

(75) Inventors: Juergen Becker, Berlin; Gerhard Behr, Altheim, both of (DE)

(73) Assignee: Patent-Treuhand-Gesellschaft fuer elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/379,444

(22) Filed: Aug. 23, 1999

(51) Int. Cl.[7] ..... H01J 5/56
(52) U.S. Cl. ..... 313/318.03; 313/318.12
(58) Field of Search ..... 313/318.03, 318.08, 313/318.09, 318.12, 25; 439/602, 605, 611

(56) References Cited

U.S. PATENT DOCUMENTS 5,757,110 * 5/1998 Motiduki et al. ..... 313/25
5,814,927 * 9/1998 Chen ..... 313/318.03

FOREIGN PATENT DOCUMENTS

| | | |
|---|---|---|
| 0 301 564 | 2/1989 | (EP) . |
| 0 310 792 | 4/1989 | (EP) . |
| 0 331 042 | 9/1989 | (EP) . |
| 0 533 250 | 3/1993 | (EP) . |
| 0 786 791 | 7/1997 | (EP) . |
| 2 507 012 | 12/1982 | (FR) . |

* cited by examiner

*Primary Examiner*—Ashok Patel
(74) *Attorney, Agent, or Firm*—William E. Meyer

(57) ABSTRACT

The invention relates to an electric lamp for a motor vehicle headlight. The lamp is equipped with an adjustment ring (4) which has at least three bearing points **(4*a*) which are arranged in a common plane oriented perpendicularly with respect to the axis of the adjustment ring (4). Along its inner circumferential surface, the adjustment ring (4) has at least three contact points (8*a*) with the lamp cap (1), in which points the adjustment ring (4) is fixed to the lamp cap (1)**.

11 Claims, 1 Drawing Sheet

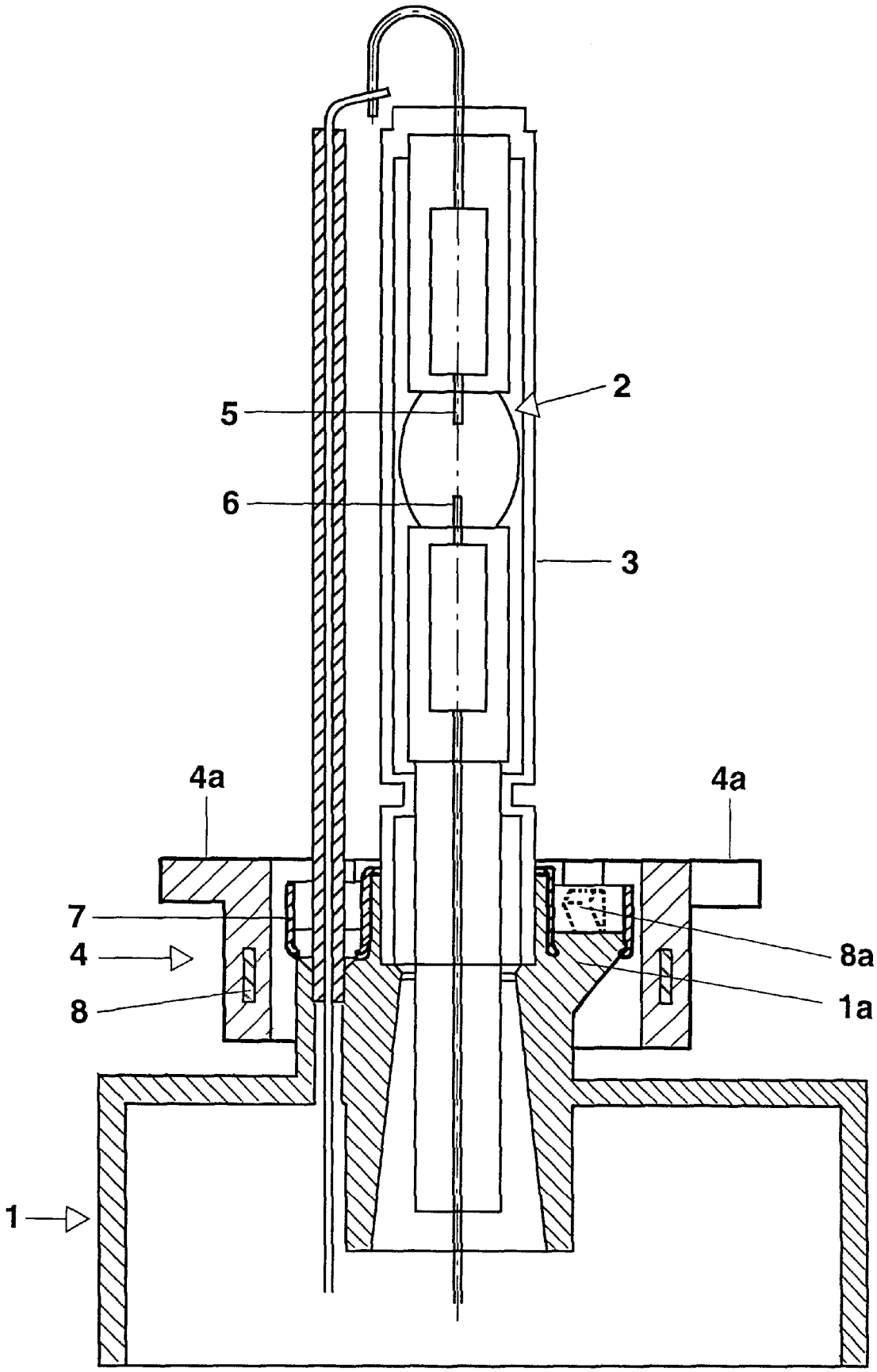
2
5
6
3
4a
4a
7
4
8
8a
1a
1

ELECTRIC LAMP

TECHNICAL FIELD

The invention relates to electric lamps and particularly to electric lamps for vehicles. More particularly the invention is concerned with the mounting structure for a vehicle lamp capsule. The invention relates to an electric lamp as described in the preamble of patent claim 1.

BACKGROUND ART

An electric lamp of this nature has been disclosed, for example, in European laid-open specification EP 0,786,791. This document describes an electric lamp, the cap of which has a cap sleeve and a holding element which is welded thereto and in which the lamp vessel is anchored. In this case, the adjustment of the luminous means takes place in two steps, during the attachment of the lamp vessel in the holding element and during welding of the holding element to the cap sleeve.

SUMMARY OF THE INVENTION

The object of the invention is to provide an electric lamp for a headlight which allows simplified adjustment of its luminous means with respect to a reference plane of the headlight.

According to the invention, this object is achieved by means of the defining features of patent claim 1. Particularly advantageous refinements of the invention are described in the subclaims.

The electric lamp according to the invention has a lamp cap with a lamp vessel which is anchored therein and surrounds a luminous means. According to the invention, the lamp is equipped with an adjustment ring which has at least three bearing points which are arranged in a common plane oriented perpendicularly with respect to the axis of the adjustment ring and which has at least three contact points with the lamp cap along its inner circumferential surface, the adjustment ring being fixed to the lamp cap in the at least three contact points. After the lamp has been fitted in the headlight, the at least three bearing points of the adjustment ring bear against a reference level in the reflector of the headlight. Their arrangement with respect to the luminous means therefore determines the position of the luminous means in the headlight reflector. The orientation of the bearing surface which is defined by the bearing points with respect to the luminous means is fixed by the position of the at least three contact points between the adjustment ring and the lamp cap. At the end of the adjustment process, the adjustment ring and the lamp cap are joined together at the at least three contact points. Since the orientation of the luminous means in the headlight is dependent only on the alignment of the adjustment ring with respect to the lamp cap, the lamp vessel can be anchored in the lamp cap even before the adjustment process and completely independently of this process. The abovementioned features of the lamp according to the invention therefore allow simple adjustment of the lamp in the headlight.

Advantageously, the at least three contact points between the adjustment ring and the lamp cap are formed by means of one or more projecting sections of the lamp cap. In the exemplary embodiment of the invention which is particularly preferred, the at least three contact points between adjustment ring and lamp cap are produced with the aid of an annular bead which is integrally formed on the lamp cap. The annular bead is advantageously made from plastic. In this way, it can be designed as a part which is integrally formed on the lamp cap and, in addition, increases the ability of the cap to withstand high voltages. The adjustment ring is advantageously also made from plastic. In order to allow spot welding between adjustment ring and bead by means of laser, advantageously at least one first metal part is anchored in the annular bead and at least one second metal part is anchored in the adjustment ring. Moreover, the first metal part or the second metal part to this end advantageously has a plurality of integrally formed resilient weld tabs.

BRIEF DESCRIPTION OF THE FIGURES

FIG. 1. show a cross sectional view of the preferred embodiment of a vehicle lamp capsule.

BEST MODE FOR CARRYING OUT THE INVENTION

The invention is explained in more detail below with reference to a preferred exemplary embodiment. The figure shows a diagrammatic cross section through the preferred exemplary embodiment of the invention.

The lamp according to the particularly preferred exemplary embodiment of the invention is a high-pressure discharge lamp which has a cap on one side and an ignitor integrated in the cap, which lamp is intended to be fitted in a motor vehicle headlight. This lamp has a lamp cap 1 which is made from plastic and in the interior of which an ignitor (not shown) for the high-pressure discharge lamp is accommodated, two glass lamp vessels 2, 3, namely a discharge vessel 2 and an outer bulb 3, and an adjustment ring 4 which is made from plastic. Two electrodes 5, 6, between which a light-emitting gaseous discharge is formed during operation of the lamp, are arranged in the discharge vessel 2. The outer bulb 3 surrounds the discharge vessel 2. One end of each of the lamp vessels 2, 3 is fixed in the lamp cap 1. The lamp cap 1 has an integrally formed annular bead 1*a*. The annular bead 1*a* surrounds the two lamp vessels 2, 3. A first metal ring 7, which forms part of the outer wall of the annular bead 1*a*, is anchored in the bead 1*a*. A second metal ring 8, which is equipped with four integrally formed resilient weld tabs 8*a*, is anchored in the adjustment ring 4. The weld tabs 8*a* project out of the inner circumferential surface of the adjustment ring 4, in the direction of the ring axis, and bear against the bead 1*a* with a clamp fit. Moreover, the weld tabs 8*a* form four contact points with the first metal ring 7 of the bead 1*a* and are spot-welded to the first metal ring 7 of the bead 1*a* at the contact points. The adjustment ring has three integrally formed reference lugs 4*a*, which are arranged in a common plane and serve as a reference plane for fitting the lamp in the headlight reflector. The form of the metal rings 7, 8 and of the weld tabs 8*a* as well as the attachment of the lamp vessels 2, 3 in the plastic material of the lamp cap 1, are described in European laid-open specification EP 0,786,791.

The invention is not limited to the exemplary embodiment described in more detail above. For example, it is also possible to dispense with one of the two metal rings 7 or 8 and to weld the bead to the adjustment ring by high-frequency-induced heating and fusion of the bead plastic material surrounding the metal ring or of the adjustment ring. Moreover, it also is possible to make the adjustment ring from a metal rather than from plastic and to equip the metal adjustment ring with integrally formed resilient weld tabs.

What is claimed is:

1. An electric lamp for a headlight, in which the lamp has a lamp cap (1), has at least one lamp vessel (2) which is anchored in the lamp cap (1), has at least one luminous means which is surrounded by the at least one lamp vessel (2), wherein the lamp has an adjustment ring (4), the adjustment ring having at least three bearing points **(4*a*) which are arranged in a common plane oriented perpendicularly with respect to the axis of the adjustment ring (4), the adjustment ring (4) having at least three contact points with the lamp cap (1) along its inner circumferential surface, and the adjustment ring (4) being fixed to the lamp cap (1)** in the at least three contact points.

2. The electric lamp as claimed in claim 1, wherein the adjustment ring (4) is made from plastic.

3. The electric lamp as claimed in claim 1, wherein the adjustment ring is made from metal.

4. The electric lamp as claimed in claim 1, wherein the lamp cap has one or more projecting sections which form the at least three contact points with the inner circumferential surface of the adjustment ring.

5. The electric lamp as claimed in claim 1, wherein the lamp cap (1) has an annular bead **(1*a*) which forms the at least three contact points with the adjustment ring (4)**.

6. The electric lamp as claimed in claim 5, wherein the annular bead **(1*a*)** is made from plastic.

7. The electric lamp as claimed in claim 6, wherein at least one first metal part (7) is anchored in the annular bead **(1*a*)**.

8. The electric lamp as claimed in claim 2, wherein at least one second metal part (8) is anchored in the adjustment ring (4).

9. An electric lamp as claimed in claims 7, wherein the first metal part (7) or the second metal part (8) has integrally formed resilient weld tabs **(8*a*) which form a soldered or weld joint between the first metal part (7) and the second metal part (8), and form the at least three contact points between the lamp cap (1) and the adjustment ring (4)**.

10. The electric lamp as claimed in claim 1, wherein the lamp is a high-pressure discharge lamp.

11. An electric lamp as claimed in claims 8, wherein the first metal part (7) or the second metal part (8) has integrally formed resilient weld tabs **(8*a*) which form a soldered or weld joint between the first metal part (7) and the second metal part (8), and form the at least three contact points between the lamp cap (1) and the adjustment ring (4)**.

* * * * *